US006640874B2

(12) United States Patent
Vorndran et al.

(10) Patent No.: US 6,640,874 B2
(45) **Date of Patent: *Nov. 4, 2003**

(54) SEALING RISER SLEEVE

(75) Inventors: Jay A. Vorndran, Medina, OH (US); John E. Gotheridge, Medina, OH (US)

(73) Assignee: American Metal Chemical Corporation, Medina, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/080,426

(22) Filed: Feb. 22, 2002

(65) Prior Publication Data

US 2002/0079080 A1 Jun. 27, 2002

Related U.S. Application Data

(62) Division of application No. 09/553,718, filed on Apr. 20, 2000, now Pat. No. 6,352,100, which is a division of application No. 08/963,736, filed on Nov. 4, 1997, now Pat. No. 6,209,617.

(60) Provisional application No. 60/030,760, filed on Nov. 6, 1996.

(51) Int. Cl.[7] ..... B22C 9/08; B22C 7/00

(52) U.S. Cl. ..... 164/15; 164/359; 164/241

(58) Field of Search ..... 164/235, 239, 164/241, 242, 243, 244, 359, 360, 7.1, 7.2, 15, 35

(56) References Cited

U.S. PATENT DOCUMENTS

| | | | | |
|---|---|---|---|---|
| 900,970 A | | 10/1908 | Washburn | |
| 969,015 A | | 8/1910 | Washburn | |
| 3,273,211 A | * | 9/1966 | Miraldi | 164/24 |
| 3,567,667 A | | 3/1971 | Rumbold | |
| 3,815,665 A | | 6/1974 | Baur | |
| 4,014,704 A | * | 3/1977 | Miller | 106/38.22 |
| 4,041,199 A | | 8/1977 | Cartwright | |
| 5,462,106 A | * | 10/1995 | Hanna | 164/15 |
| 6,209,617 B1 | * | 4/2001 | Vorndran et al. | 164/359 |
| 6,349,757 B1 | * | 2/2002 | Vorndran et al. | 164/15 |
| 6,352,100 B1 | * | 3/2002 | Vorndran et al. | 164/241 |

FOREIGN PATENT DOCUMENTS

| | | | |
|---|---|---|---|
| DE | 1940880 | * | 2/1971 |
| GB | 584407 | | 1/1947 |
| GB | 1204472 | | 9/1970 |

OTHER PUBLICATIONS

Neral, Inc., "Abstract: Riser Sleeves for Metal Casting Moulds," Database Printout of Riser Sleeves Literature/Patents, Item 1, ASM 88–00 880451–0690 NDN–100–0081–9842–2, Neral, Inc. (U.S.), (Nov. 14, 1996).

(List continued on next page.)

*Primary Examiner*—Tom Dunn
*Assistant Examiner*—Kevin McHenry
(74) *Attorney, Agent, or Firm*—Daniel D. Wasil; Ralph E. Jocke; Walker & Jocke

(57) ABSTRACT

A riser sleeve apparatus (10) for preparing and insulating a passage (14) within which molten metal is accumulated prior to its movement into a mold cavity which includes an inner surface (12) which longitudinally extends between a first end (16) and a second end (18) wherein the inner surface bounds the passage. The riser sleeve further includes an annular lip (20) which is positioned adjacent the second end and extends inward into the passage. When the riser sleeve is positioned about a plug of a pattern, the annular lip deforms to seal the passage at the second end. A process for forming a cast metal article using said riser sleeve apparatus. A process for forming the riser sleeve apparatus.

18 Claims, 2 Drawing Sheets

OTHER PUBLICATIONS

Neral, Inc., "Abstract: Cavity Former for Use in the Production of a Metal Casting Mould Having a Riser," Database Printout of Riser Sleeves Literature/Patents, Item 2, ASM 84–00 840651–0813 NDN–100–0066–1136–0, Neral, Inc. (U.S.), (Nov. 14, 1996).

Neral, Inc., "Abstract: Riser Sleeves," Database Printout of Riser Sleeves Literature/Patents, Item 3, ASM 83–00 830951–0975 NDN–100–0062–9121–2, Neral, Inc. (U.S.), (Nov. 14, 1996).

Neral, Inc., "Abstract: Riser Sleeves for Metal Casting Moulds," Database Printout of Riser Sleeves Literature/Patents, Item 4, EPA 86–52 0206507 NDN–050–0012–2078–0, Neral, Inc. (U.S.), (Nov. 14, 1996).

Neral, Inc., "Method of Producing a Mould Open Riser in Mould During Casting," Database Printout of Riser Sleeves Literature/Patents, Item 5, PAT 10–31–95 05462106 NDN–095–0220–4489–4, Neral, Inc. (U.S.), (Nov. 14, 1996).

Neral, Inc., "Abstract: Riser Sleeve With Breaker Core," Database Printiout of Riser Sleever Literature/Patents, item 6, Pat 04–05–94 05299625 NDN–095–0202–1331–7, Neral, Inc. (U.S.), (Nov. 14, 1996).

Neral, Inc., "Abstract: Riser Sleeves for Metal Casting Moulds," Database Printout of Riser Sleeves Literature/Patents, Item 7, PAT 00–00–87 04665966 NDN–167–0129–2587–6, Neral, Inc. (U.S.), (Nov. 14, 1996).

Neral, Inc., "Abstract: Casting Mould, and Cavity Former and Sleeve for Use Therewith," Database Printout of Riser Sleeves Literature/Patents, Item 8, PAT 00–00–86 04574869 NDN–167–0119–4940–0, Neral, Inc. (U.S.), (Nov. 14, 1996).

Neral, Inc., "Abstract: Horizontal Earth Boring Directional Guide," Database Printout of Riser Sleeves Literature/Patents, Item 9, PAT 00–00–85 04546835 NDN–167–0116–0749–4, Neral, Inc. (U.S.), (Nov. 14, 1996).

Neral, Inc., "Abstract: Method for Production of a Metal Casting Mould Having a Riser and a Cavity Former and Riser Sleeve for Use Therein," Database Printout of Riser Sleeves Literature/Patents, Item 10, PAT 00–00–84 04423762 NDN–164–0103–2272–8, Neral, Inc. (U.S.), (Nov. 14, 1996).

Neral, Inc., "Abstract: Insulating Riser Sleeve," Database Printout of Riser Sleeves Literature/Patents, Item 11, PAT 00–00–82 D0266567 NDN–167–0090–5303–1, Neral, Inc. (U.S.), (Nov. 14, 1996).

Neral, Inc., "Abstract: Refractory Exothermic Heating Insulating Articles," Database Printout of Riser Sleeves Literature/Patents, Item 12, PAT 00–00–80 04201606 NDN–167–0078–9011–9, Neral, Inc. (U.S.), (Nov. 14, 1996).

Neral, Inc., "Abstract: Breaker Cores," Database Printout of Riser Sleeves Literature/Patents, Item 13, PAT 00–00–79 04141406 NDN–166–0072–4486–7, Neral, Inc. (U.S.), (Nov. 14, 1996).

Neral, Inc., "Abstract: Feeding Unit for a Casting," Database Printout of Riser Sleeves Literature/Patents, Item 14, PAT 00–00–78 04131152 NDN–166–0071–0598–3, Neral, Inc. (U.S.), (Nov. 14, 1996).

Neral, Inc., "Abstract: Foundry Riser Sleeve," Database Printout of Riser Sleeves Literature/Patents, item 15, PAT 00–00–78 D0249886 NDN–166–0064–3880–0, Neral, Inc. (U.S.), (Nov. 14, 1996).

Neral, Inc. "Abstract: Foundry Riser Sleeve," Database Printout of Riser Sleeves Literature/Patents, Item 16, PAT 00–00–89 D0248481 NDN–166–0064–2478–3, Neral, Inc. (U.S.), (Nov. 14, 1996).

Neral, Inc., "Abstract: Foundry Riser Sleeve," Database Printout of Riser Sleeves Literature/Patents, Item 17, PAT 00–00–78 D024880 NDN–166–0064–2477–1, Neral, Inc. (U.S.), (Nov. 14, 1996).

Neral, Inc., "Abstract: Foundry Riser Sleeve ," Database Printout of Riser Sleeves Literature/Patents, Item 18, PAT 00–00–78 D0248479 NDN–166–0064–2476–0, Neral, Inc. (U.S.), (Nov. 14, 1996).

Neral, Inc., "Abstract: Insulating Refractory Fiber Composition and Articles for use in Casting Ferrous Metals," Database Printout of Riser Sleeves Literature/Patents, Item 19, PAT 00–00–77 04014704 NDN–166–0058–9748–3, Neral, Inc. (U.S.), (Nov. 14, 1996).

Neral, Inc., "Abstract: Shaped Heat Insulating Articles," Database Printout of Riser Sleeves Literature/Patents, Item 20, PAT 00–00–77 04008109 NDN–166–0058–3156–3, Neral, Inc. (U.S.), (Nov. 14, 1996).

Neral, Inc., "Abstract: Heat–Insulating Shaped Compositions," Database Printout of Riser Sleeves Literature/Patents, Item 21, PA1 73–11–06 03770466 NDN–103–0016–6925–2, Neral, Inc. (U.S.), (Nov. 14, 1996).

* cited by examiner

SEALING RISER SLEEVE

This application is a divisional of U.S. application Ser. No. 09/553,718 filed Apr. 20, 2000, now U.S. Pat. No. 6,352,162 which is a divisional of U.S. application Ser. No. 08/963,736 filed Nov. 4, 1997, now U.S. Pat. No. 6,209,617, which claims the benefit of U.S. Provisional Application No. 60/030,760 filed Nov. 6, 1996.

TECHNICAL FIELD

This invention relates to methods of making metal castings, particularly to the incorporation of riser sleeves into a sand mold during the preparation of the mold for receiving molten metal in the formation of metal castings.

BACKGROUND ART

The use of riser sleeves are well known in the prior art. Riser sleeves are used as a conduit within which molten metal is accumulated before the molten metal ultimately flows from the riser sleeve into a preformed cavity within a mold. Riser sleeves are manufactured from heat insulating materials to prevent the molten metal from solidifying within the riser sleeve before it passes to the preformed cavity. Typically, riser sleeves are manufactured from heat insulating refractory materials, including man-made fibers. Riser sleeves can include fuels such as aluminum or silicon which are used to produce their respective heat insulating oxides during an exothermic reaction within the riser sleeve. Riser sleeves are produced to have low densities and high porosities to provide additional good heat insulating properties.

There are two major types of riser sleeves in the prior art: open top riser sleeves and blind riser sleeves. Blind riser sleeves comprise a hollow dome shaped riser sleeve, whereas open top riser sleeves are generally annular shaped. Blind riser sleeves are more expensive to manufacture and are only used in special applications. Open top riser sleeves allow the casting operator to see the progress of the cast by visualizing the level of the molten metal in the riser sleeve. Because of their prevalence, for purposes of this specification and the claims, the term riser sleeve only refers to open top riser sleeves.

Patterns are used to create a mold cavity conforming to the casting configuration. Riser plugs or riser location plugs, hereinafter referred to as plugs, are used to create the riser passage itself and to locate the riser sleeve in a desired position on the casting. In operation the riser sleeves hold a reservoir of liquid metal in fluid communication with the mold cavity. The plugs are positioned on the casting in a location which provide liquid metal to compensate for the volumetric change which takes place in the cooling metal within the mold cavity.

During the formation of the mold, the plug is positioned adjacent the selected pattern and the prior art riser sleeves are placed on the plug. The plug is made to be slightly smaller than the nominal interior diameter of the riser sleeve. However plugs are typically not symmetrical in shape and gaps between the plug and the interior surface of the riser sleeve are common.

There are two types of molding sand typically used in the preparation of a mold, i.e. "green" sand and "no-bake" sand. Green sand is composed of sand, clays, water and other additives. No-bake sand is composed of sand and bonding agents such as resins, catalysts and other additives to create a chemically bonded self hardening molding sand. Both of these molding sands are placed about the exterior of the pattern assembly by means of hand ramming, machine jolting and squeezing, high pressure squeezing, sand slinging etc. to form the mold. When the molding sand is positioned in this way, it often accumulates in the interstitial space formed by the external surface of the plug and the internal surface of the riser sleeve. In the case of the self hardening no-bake sand, when the molding sand hardens it is difficult to remove the plug from the riser sleeve without hammering the plug from the sleeve or otherwise coercing it. When such coercive forces are used on the plug, or pattern assembly the plug and pattern may become damaged requiring repair. Also the vibration from the coercive forces causes the riser sleeve to become loosened from the surrounding molding medium causing it to shift during pouring, producing an undesired lump or fin on the casting which must be removed by grinding or other removal method.

This prior art riser sleeve can also produce quality control problems. The molding sand which accumulates in the interstitial space between the riser sleeve and the plug must be removed. The accumulated molding sand is most often a thin layer of sand left adhered to the internal wall of the riser sleeve after the plug is removed. The frequency which this layer of sand is formed is such that a position on the metal casting assembly line is dedicated to the task of removing it. This sand layer is removed with the aid of implements such as a molder's trowel or file. The removal is necessary to prevent the sand from later falling into the mold cavity during movement of mold or while the mold is filled with molten metal. Any sand which so enters the mold cavity creates unwanted inclusions and unacceptable metallurgical imperfections which must be removed from the casting after it has cooled. This removal process is very time consuming and costly.

Thus, there exists a need in the prior art for a sealing apparatus to prevent molding sand from entering the passage within the riser sleeve.

DISCLOSURE OF THE INVENTION

An object of the present invention is to provide a riser sleeve apparatus which prevents molding sand from entering the interstitial space between a riser sleeve and the plug of a cast pattern.

A further object of the present invention is to provide a riser sleeve apparatus which reduces the time for preparing a metal molding, by allowing for the easy stripping of the pattern and plug.

A further object of the present invention is to provide a riser sleeve apparatus which eliminates impurities in the finished cast product by preventing molding sand from entering the mold cavity prior to and during metal pouring.

A further object of the present invention is to provide a riser sleeve apparatus which eliminates the need to remove accumulated sand from the interior of the riser sleeve prior to metal pouring.

A further object of the present invention is to provide a riser sleeve apparatus which is easy to use and to manufacture.

Further objects of the present invention will be made apparent in the following Best Modes for Carrying Out Invention and the appended Claims.

The foregoing objects are accomplished in the preferred embodiment of the invention by a riser sleeve apparatus which is used for preparing and insulating a passage within which molten metal is accumulated prior to its movement into a mold cavity. The riser sleeve comprises an inner surface which longitudinally extends between an open first end and an open second end. The inner surface bounds the molten metal passage.

The riser sleeve further comprises an annular lip which is positioned adjacent the inner surface and extends inward into the passage. The annular lip includes an engagement edge which is deformable. The annular lip further includes a lower surface and a top surface. The lower surface extends from the inner surface at a generally 45° angle. The top surface is an extension of the second end. Thus, the annular lip extends from the inner surface adjacent the second end.

The annular lip is adapted for engagement with an exterior surface of any article extending through the passages, such as a plug. The annular lip deforms to engage the article about the perimeter of the article sealing the area above the second end from the interstitial space created between the article and the inner surface.

The first end of the riser sleeve is adapted to facilitate fluid communication between the passage and the mold cavity. The first end extends at an angle generally normal to the inner surface to allow engagement of the first end with the top surface of a pattern. This engagement seals the passage adjacent the first end from any molding sand placed about the riser sleeve and pattern.

The riser sleeve is generally manufactured from fibrous refractory material. The riser sleeve is manufactured by vacuum forming the refractory material from a slurry onto a preformed mesh. The riser sleeve is used in a process for forming a metal cast comprising the steps of first positioning the riser sleeve about a plug of a pattern assembly. The plug can be screwed or otherwise fastened upon the top surface of the selected pattern. When the riser sleeve is placed upon the plug it is secured about the plug so that the annular lip of the riser sleeve engages an exterior surface of the plug. To secure the riser sleeve, the riser sleeve is moved toward the plug while annular lip moves past the external surface of the plug deforming the annular lip. When the annular lip is so deformed, the engagement edge of the annular lip seals against the external surface about the entire perimeter of the external surface. The preferred method of so securing the riser sleeve onto the plug is to rotate the riser sleeve relative the plug which causes the annular lip to deform about the external surface of the plug and to seal about the perimeter of the plug.

When the riser sleeve is so secured, its longitudinal position is fixed and the first end is also sealed against the top surface of the pattern. With the passage of the riser sleeve sealed at both the first and second ends, molding sand can be formed about the exterior of the pattern and the riser sleeve. Molding sand is prevented from entering the interstitial space between the riser sleeve and the plug by the annular lip.

When the molding sand is hardened, the pattern with the plug is stripped from the interior of the molding sand leaving a mold cavity which is formed by the pattern. The passage within the riser sleeve is left in communication with the formed mold cavity. By preventing the accumulation of molding sand within the interstitial space the plug is stripped from the passage with relative ease. When the mold thus assembled, metal can be cast by pouring it into the mold cavity.

In a preferred embodiment for manufacturing the sealing riser sleeve, the process of vacuum forming is utilized. The process for vacuum forming a sealing riser sleeve comprising the steps of slurrying a mixture of heat insulating materials in a container. A perforated former is then lowered into the mixture. The perforated former includes a first surface and a second surface. The perforated former includes a groove about the perimeter of the first surface. The second surface of the perforated former is in operative communication with a vacuum source. The vacuum source can be selectively put into and out of fluid communication with the second surface. When the vacuum source is in communication with the second surface it causes the heat insulating materials within the slurry to deposit on the first side of the perforated former. The deposited materials form a sealing riser sleeve. When the desired thickness of heat insulating materials is deposited, the communication of the vacuum source with the second surface is stopped, and the formed sealing riser sleeve is removed from the perforated former. The formed sealing riser sleeve includes an annular lip formed by the groove.

BRIEF DESCRIPTION OF DRAWINGS

In the preferred embodiment of the invention, a riser sleeve apparatus is described herein in detail with reference to the accompanying drawings.

BEST MODES FOR CARRYING OUT INVENTION

Figure 1:
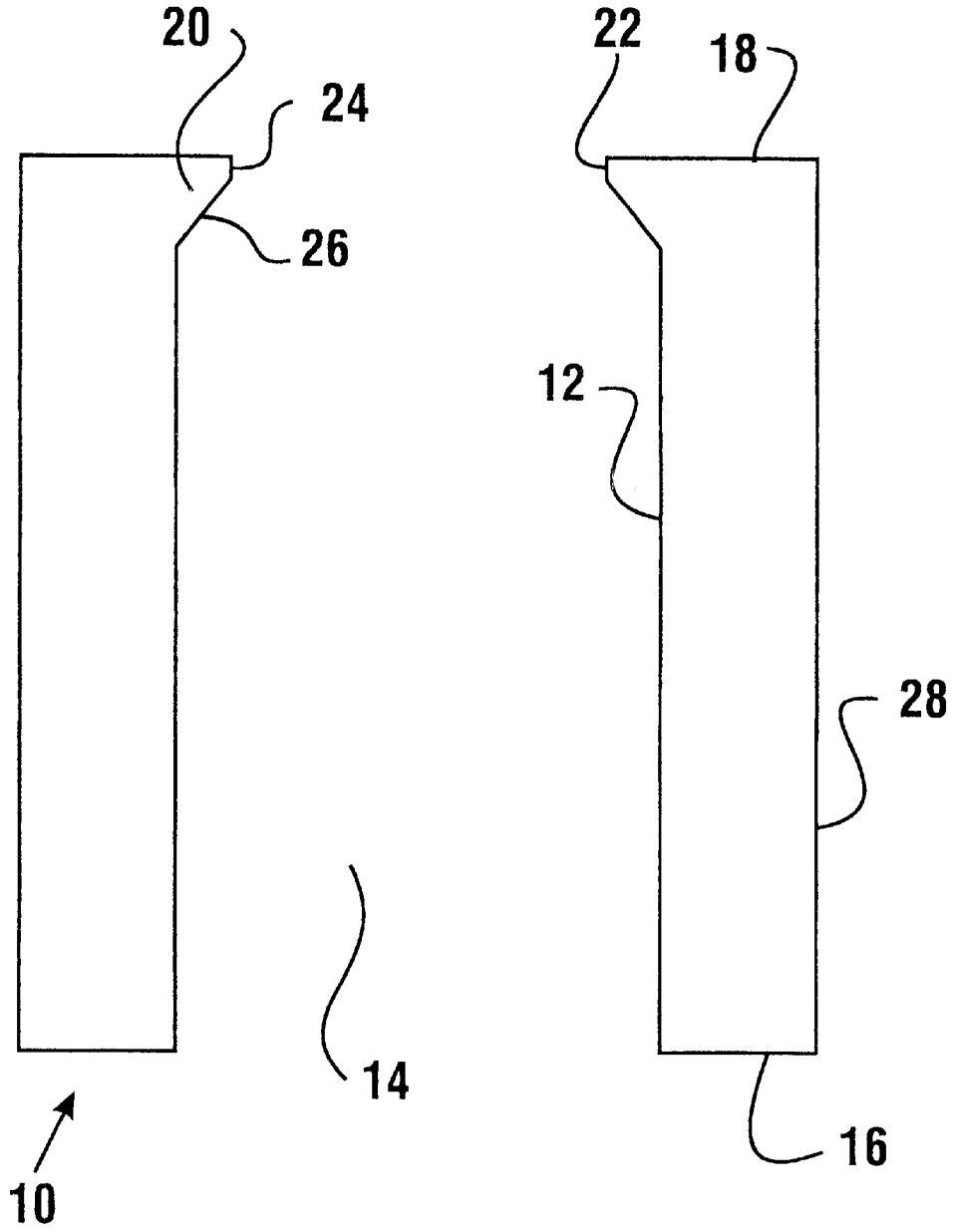
FIG. 1 is a cross sectional view of the riser sleeve apparatus of the present invention.

Referring now to the drawings and particularly to FIG. 1, a cross sectional view of the riser sleeve 10 of the present invention is shown. The riser sleeve comprises an inner surface 12 which bounds a generally cylindrical passage 14. Although depicted cylindrical, the inner surface can be shaped in other alternative configurations. The passage extends between an open first end 16 of the riser sleeve and an open second end 18. The first end extends generally normal to the longitudinally inner surface. The first end is shaped to seal the passage against a generally planar surface.

The riser sleeve further includes an annular lip 20. The annular lip extends from the inner surface adjacent the second end. The annular lip includes a top surface 22 which comprises an extension of the surface of the second end 18. The annular lip further includes an engagement edge 24 which is positioned at the termination of the top surface. Engagement edge 24 is deformable and has a variable surface area. When undeformed the engagement edge is tapered to narrow circular surface. When deformed the surface of the engagement edge increases to form a sealing surface.

The annular lip further comprises a bottom surface 26 which extends from the inner surface to the engagement edge at a generally 45° angle. This angle reinforces the annular lip and minimizes the shear stresses when the engagement edge is deformed. The riser sleeve further includes an outer surface 28 which extends concentrically about the inner surface and like the inner surface is generally smooth and unornamented.

The riser sleeve of the present invention is manufactured from moldable exothermic material, insulating exothermic material or insulating material. For purposes of the specification and the claims, moldable exothermic material is defined as those materials with components which react exothermically when exposed to the heat of the liquid metal within the riser sleeve. The exothermic reactions act to heat the liquid metal within the riser sleeve to prevent its solidification. The reaction byproducts, primarily oxides, increases the refractoriness of the composition. These materials generally have little heat insulating properties and their functionality relies solely on their ability to create heat. Typically the heat producing reactants include fine aluminum or silica powders, but other suitable reactants include organic fibers e.g. rayon, cotton, jute, etc. These reactants are incorporated into a structure forming mixture of sand and other refractories including olivine sand, mullite, kyanite, crushed firebrick, and calcined alumina. The riser sleeves manufactured from these exothermic materials are formed by injection molding processes such as blowing.

Insulating materials do not include any component which reacts exothermically. Instead the functionality of insulating materials is based upon their ability to retard the loss of heat from the liquid metal within the riser sleeve therefore allowing it to maintain its temperature and remain in the liquid state. There are primarily two means in which the insulating material act to retain the heat within the liquid metal. The first is the composition of the insulating materials. Insulating materials generally include components with high heat resistance such as man made ceramics incorporating materials such as kaolin clays, silicas, alumina and zirconium. The second means for increasing the insulating properties of riser sleeves is in their structure. Riser sleeves composed of insulating materials are generally produced to have low densities and high porosities to provide additional good heat insulating properties. To produce these insulating structures fibrous refractory materials are typically used.

Insulating exothermic materials include properties from both the exothermic materials and the insulating materials. These materials utilize both exothermic reactants and good insulating properties to maintain the temperature of the liquid metal above its solidification point.

In the preferred embodiment of the invention the riser sleeve is composed of a mixture of fibrous refractory material held together with a binder. Examples of the materials which compose the fibrous refractory material include calcium silicate fibers, crushed coke, asbestos, slag wool and eldorite. Examples of binders include resins such as urea-formaldehyde, phenol-formaldehyde and mixtures thereof. Other binders such as starches, dextrins, colloidal silicas and colloidal aluminas can also be used. The riser sleeve is formed by first slurrying the fibrous refractory material with binder in an aqueous solution and holding the resulting slurry within a slurry tank. A perforated former is connected by a conduit to a vacuum pump and adapted to be removable from a wholly immersed end. The perforated former is also positioned to be immersed in the slurry and the slurry tank and when so immersed to be static in the tank.

To form the riser sleeve of the present invention the liquid is drawn through the perforated former while the fibrous refractory material wetted in the resin is deposited out on the outside surface of the perforated former. The pumping of the liquid is continued until the desired thickness of fibrous refractory material is deposited on the former by the action of the vacuum pump. The former is then raised clear of the slurry in the slurry tank. Air can be drawn through the shaped deposit further dewatering it while adding porosity to the walls of the shaped deposit. When the desired water content is achieved, the shaped deposit is stripped from the former by any convenient method. The formed riser sleeve is then dried in an oven or other similar apparatus.

In the preferred embodiment of the invention, the shape configuration of the inner surface and the annular lip of the riser sleeve is formed by the external shape of the perforated former. The annular lip comprises a protruding concentric portion which is formed by a mating concentric groove in the annular perforated former. Although the above described method of creating the annular lip is preferred, alternative methods include attaching an elastomeric seal about the perforate former so that it is incorporated and held within the vacuum formed fibrous refractory material. The concentric elastomer seal protrudes from the riser sleeve in the same position and manner in which the above described annular lip is positioned. The elastomeric seal acts in the manner as described by the annular lip to prevent the molding sand from entering the passage through the second end. Unlike the fibrous refractory material of the annular seal, the elastomeric seal is incapable of withstanding the heat of the molten metal falling through the passage. However the elastomeric seal will quickly oxidize or pyrolyze with the heat of the molten metal and its gaseous byproducts will not enter into the molten metal stream.

Other sealing means are included in the present invention such as: a preformed ceramic seal affixed during the vacuum forming of the riser sleeve, packing material for insertion in and for sealing the passage, a removable lid insertable onto the second end of the riser sleeve and any other means for preventing molding sand from entering the passage and which does not require additional effort to remove.

Figure 2:
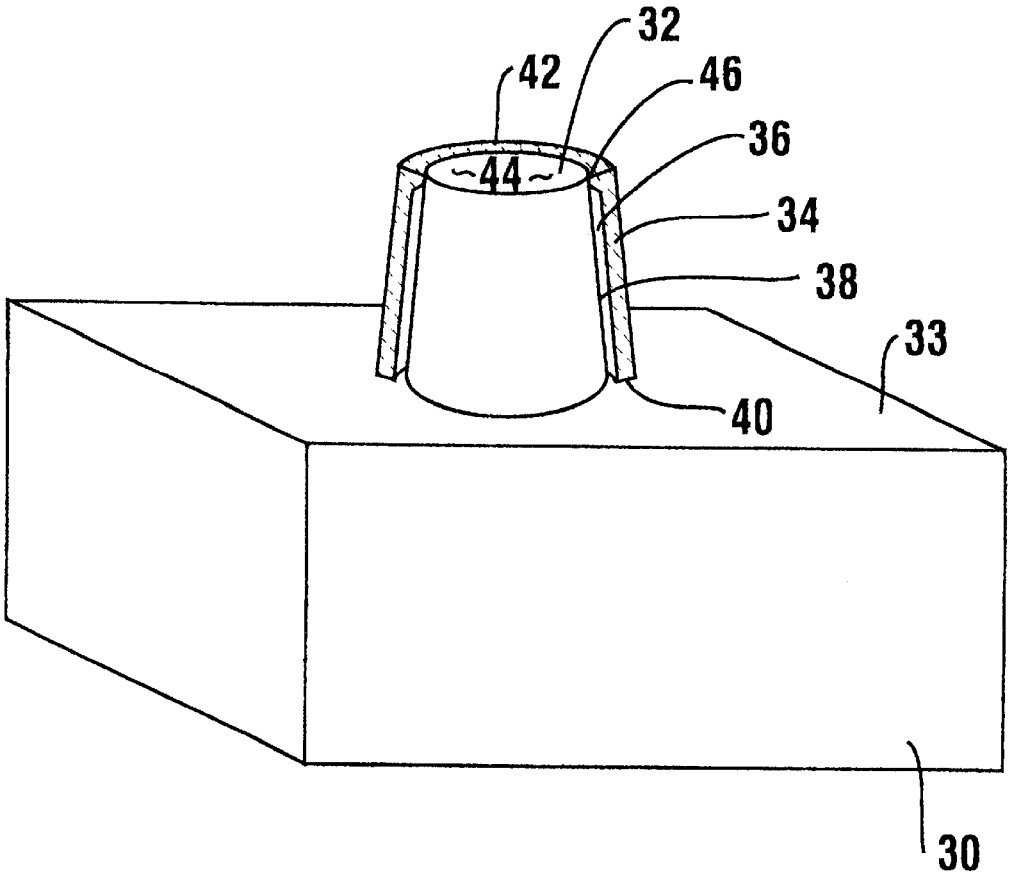
FIG. 2 is a side elevational view of the riser sleeve placed onto the plug of a pattern.

Referring now to FIG. 2, there is shown a side elevational view of a pattern 30, a plug 32 and a riser sleeve 34. The pattern shown is a rectangular solid but is not limited to this shape. The pattern is normally manufactured from wood, plastic, aluminum, cast iron or other durable material and its external shape forms the shape of the mold cavity. To facilitate the entry of molten metal into the mold cavity, at least one plug 32 is placed onto a top surface 33 of the pattern. The shape of the plug helps define the shape of a passage 36 through which the molten metal will flow into the mold cavity. The plug is similarly manufactured from wood or another durable material and is usually screwed or otherwise fastened to the top surface of the pattern. The plug can be left unfastened to the pattern if its position will not be changed during the mold preparation process.

After the plug is secured to the top surface of the pattern the riser sleeve 34 is positioned about the outer surface 38 of the plug. FIG. 2 shows the riser sleeve 34 having an annular body inwardly tapered from a first end 40 to a second end 42. The riser sleeve is positioned so that the first end 40 is positioned adjacent the top surface 33 of the pattern. Likewise the second end of the riser sleeve 42 is positioned adjacent a top surface 44 of the plug. The annular lip extends generally 1/16" over the top surface 44 about the entire perimeter of the plug. The riser sleeve is secured on the plug by forcing it downward onto the plug causing the top surface of the plug to engage the annular lip 46 of the riser sleeve. In the preferred method of securing the riser sleeve onto the plug, the riser sleeve is rotated one quarter turn relative the plug while it is forced downward. The angle of the bottom surface 26 allows the annular lip to deform gradually as the annular lip passes the top surface of the plug. This gradually deformation prevents the annular lip from breaking away under the shearing forces of this engagement.

The rotation of the riser sleeve secures the position of the annular lip onto the external surface of the plug. The annular lip is deformed by the movement of the sleeve and its increased surface area engages the outer surface 38 of the plug continuously about the perimeter of the plug. The engagement of the annular lip 46 with the outer surface of the plug 38 seals the passage 36 at the second end 42 of the riser sleeve. Likewise the engagement of the annular lip secures the position of the riser sleeve relative the plug and positions the first end of the riser sleeve 40 in engagement with the top surface of the pattern 33. This engagement seals the passage 36 at the first end of the riser sleeve.

Once the passage is sealed, molding sand is placed about the exterior of the pattern and the riser sleeve. No-bake molding sand contains a quick set binder which sets the molding sand and causes it to harden into a cast. The mold is formed with an internal cavity formed about the pattern and the riser sleeve. Once the cast is entirely hardened, the pattern is stripped from the mold. With the passage free from molding sand the plug can be easily removed from the passage with manual manipulation and without the need for forceful coercion. The seal between the annular lip and the plug maintain the position of the riser sleeve relative the pattern throughout the time in which the molding sand is hardened. Thus, the resulting internal cavity formed within the molding sand is in sealed communication with the passage 36. The molding sand formed or hardened about the first end of the riser sleeve seals this intersection between the pattern and the internal cavity of the molding sand.

Once the pattern and plug are stripped and the cast is reassembled, molten metal can be poured into the internal cavity of the mold. Typically the molten metal is poured throughout the volume of the internal cavity and allowed to accumulate up through the passage until it is stopped at the second end of the riser sleeve. The metal is then allowed to solidify and the mold is broken from the hardened metal. Because of the sealed engagement between the first end of the riser sleeve and the molding sand adjacent the formerly positioned top surface of the pattern, no finning of the molten metal occurs and instead a perfectly formed cast results in an optimized period of time.

The finished cast is free from any surface or internal imperfections caused by molding sand entering into the mold cavity. One of the most frequent bottlenecks in cast manufacturing is in the cleaning room in which imperfections are removed from the finished cast product. The invention reduces this bottleneck by eliminating all defects caused by molding sand. The invention further reduces the time in preparing the mold by eliminating the need for the removal of accumulated molding sand from the interior of the riser sleeve. In one foundry in which the invention was tested, an entire station on the mold preparation assembly line was rendered obsolete and eliminated because the absence of any molding sand within the riser sleeve. In this foundry the pattern and plug preparers noted a dramatic decrease in the number of plugs which required repairs.

Thus, the invention achieves the above stated objectives, eliminates difficulties encountered in the use of prior devices, solves problems and attains the desirable results described above.

In the foregoing description certain terms have been used for brevity, clarity and understanding. However, no unnecessary limitations can be implied therefrom because such terms are used for descriptive purposes and are intended to be broadly construed. Moreover, the description or illustrations given are by way of examples and the invention is not limited to the exact details shown or described.

Having described the features, discoveries and principles of the invention, the manner in which it is construed, and the advantages and useful results obtained; new and useful structures, devices, elements, arrangements, parts, combinations, systems, equipment, operations and relationships are set forth in the appended claims.

We claim:

1. A riser sleeve apparatus adapted to engage a riser location plug having a top surface and a perimeter and positioned on a surface of a mold cavity pattern, and wherein the apparatus is adapted to create and insulate a passage within which molten metal is accumulated, the apparatus comprising:

a riser sleeve including an inner surface longitudinally extending between an open first end and an open second end, wherein the inner surface bounds the passage, wherein the first end is adapted to fluidly communicate with a mold cavity adjacent the mold cavity, an annular lip positioned adjacent the inner surface and extending inward into the passage, wherein the annular lip extends from the inner surface adjacent the second end, wherein the riser sleeve is adapted to be positioned about an outer surface of the riser location plug, wherein the second end is adapted to be positioned adjacent the top surface of the riser location plug, and wherein the annular lip is adapted to engage the riser location plug about the perimeter of the plug.

2. A process comprising the steps of:

(a) positioning a riser sleeve about a mold cavity pattern assembly riser location plug, and (b) securing the riser sleeve about the plug, wherein an inward lip of the riser sleeve engages an exterior surface of the plug.

3. The process of claim 2 further comprising preventing entry of sand into the riser sleeve during a mold making process.

4. Apparatus adapted to create and insulate a passage within which molten metal may accumulate, the apparatus comprising:

a riser location plug having an exterior surface, wherein the riser location plug is adapted to be positioned in operative connection with a mold cavity pattern assembly, a riser sleeve including an inner surface, wherein the inner surface bounds the passage, a lip positioned adjacent the inner surface and extending inward into the passage, wherein the riser sleeve is adapted to be positioned about the exterior surface of the riser location plug, and wherein the lip is adapted to engage the exterior surface of the plug.

5. The apparatus of claim 4 wherein the lip is adapted to engage the exterior surface of the plug to prevent entry of sand into the riser sleeve.

6. An apparatus comprising:

a riser sleeve including an inner surface, wherein the inner surface bounds a passage, wherein the riser sleeve is adapted to insulate the passage within which molten metal may accumulate, a portion positioned adjacent the inner surface and extending inward into the passage, wherein the riser sleeve is adapted to be positioned about the exterior surface of a mold cavity pattern assembly riser location plug, and wherein the portion is adapted to engage the exterior surface of the plug.

7. The apparatus of claim 6 wherein the portion is an annular portion.

8. The apparatus of claim 6 wherein the portion includes an engagement edge, wherein the engagement edge is deformable.

9. The apparatus of claim 6 wherein the portion is adapted to engage the plug about a perimeter of the plug.

10. The apparatus of claim 6 wherein the portion is adapted to seal the riser sleeve to the plug.

11. The apparatus of claim 6 wherein the portion is a lip.

12. The apparatus of claim 11 wherein the lip is an annular lip.

13. The apparatus of claim 6 wherein the portion extends inward of the inner surface a predetermined length.

14. The apparatus of claim 6 wherein the riser sleeve is manufactured from fibrous refractory material.

15. The apparatus of claim 6 wherein the inner surface longitudinally extends between an open first end and an open second end, wherein the portion extends from the inner surface adjacent the second end, wherein the first end is adapted to fluidly communicate with a mold cavity adjacent the mold cavity, wherein the second end is adapted to be positioned adjacent a top surface of the plug positioned on a surface of a mold cavity pattern.

16. An apparatus comprising:

a riser sleeve including an inner surface, wherein the inner surface bounds a passage, wherein the riser sleeve is adapted to insulate the passage within which molten metal may accumulate, a deformable portion positioned adjacent the inner surface and extending inward into the passage, wherein the riser sleeve is adapted to be positioned about the exterior surface of a mold cavity pattern assembly riser location plug, and wherein the deformable portion is adapted to engage the exterior surface of the plug.

17. The apparatus of claim 16 wherein the deformable portion is a deformable annular portion.

18. An apparatus comprising:

a riser sleeve including an inner surface, wherein the inner surface bounds a passage, wherein the riser sleeve is adapted to insulate the passage within which molten metal may accumulate, wherein the inner surface longitudinally extends between an open first end and an open second end, wherein the first end is adapted to fluidly communicate with a mold cavity adjacent the mold cavity, wherein the first end is adapted to be intermediate the second end and the mold cavity during fluid communication, a portion positioned adjacent the inner surface and extending inward into the passage, wherein the portion extends from the inner surface adjacent the second end, wherein the riser sleeve is adapted to be positioned about the exterior surface of a mold cavity pattern assembly riser location plug, and wherein the portion is adapted to engage the exterior surface of the plug.

* * * * *